US009653790B2

(12) United States Patent
Jan et al.

(10) Patent No.: US 9,653,790 B2
(45) Date of Patent: May 16, 2017

(54) DUAL-BAND ANTENNA

(71) Applicant: Wistron NeWeb Corp., Hsinchu (TW)

(72) Inventors: Cheng-Geng Jan, Hsinchu (TW); Chieh-Sheng Hsu, Hsinchu (TW)

(73) Assignee: Wistron NeWeb Corp., Hsinchu (TW)

( * ) Notice: Subject to any disclaimer, the term of this patent is extended or adjusted under 35 U.S.C. 154(b) by 88 days.

(21) Appl. No.: 14/715,548

(22) Filed: May 18, 2015

(65) Prior Publication Data

US 2016/0020515 A1 Jan. 21, 2016

(30) Foreign Application Priority Data

Jul. 16, 2014 (TW) ..... 103124427 A

(51) Int. Cl.

| | |
|---|---|
| ***H01Q 1/38*** | (2006.01) |
| ***H01Q 5/00*** | (2015.01) |
| ***H01Q 1/48*** | (2006.01) |
| ***H01Q 5/10*** | (2015.01) |
| ***H01Q 9/40*** | (2006.01) |
| ***H01Q 9/42*** | (2006.01) |

(52) U.S. Cl.

CPC ..... *H01Q 1/48* (2013.01); *H01Q 5/10* (2015.01); *H01Q 9/40* (2013.01); *H01Q 9/42* (2013.01)

(58) Field of Classification Search

CPC ..... H01Q 1/48; H01Q 9/40; H01Q 9/42

See application file for complete search history.

(56) References Cited

U.S. PATENT DOCUMENTS 6,380,895 B1 * 4/2002 Moren ..... H01Q 1/243 343/700 MS

2001/0022559 A1 * 9/2001 Takahashi ..... H01Q 1/3291 343/724

FOREIGN PATENT DOCUMENTS

| | | |
|---|---|---|
| TW | M299358 | 10/2006 |
| TW | 200915665 | 4/2009 |

OTHER PUBLICATIONS

Su et al., "Internal Ultrawideband Monopole Antenna for Wireless USB Dongle Applications," IEEE Transactions on Antennas and Propagation, Apr. 2007, pp. 1180-1183.

"Office Action of Taiwan Counterpart Application", issued on Dec. 16, 2015, p. 1-p. 5.

* cited by examiner

*Primary Examiner* — Robert Karacsony

*Assistant Examiner* — Amal Patel

(74) *Attorney, Agent, or Firm* — Jianq Chyun IP Office

(57) ABSTRACT

A dual-band antenna including a ground element, a radiation element and at least one open slot is provided. The radiation element has a bending to form a first radiation portion and a second radiation portion. The first radiation portion has a feeding point adjacent to the ground element. The width of the first radiation portion is gradually increased along a direction far away from the ground element. The second radiation portion forms an orthogonal projection on the ground element. One open slot at least passes through the second radiation portion.

9 Claims, 8 Drawing Sheets

DUAL-BAND ANTENNA

CROSS-REFERENCE TO RELATED APPLICATION

This application claims the priority benefit of Taiwan application serial no. 103124427, filed on Jul. 16, 2014. The entirety of the above-mentioned patent application is hereby incorporated by reference herein and made a part of this specification.

BACKGROUND

Field of the Invention

The invention is directed to an antenna and more particularly, to a dual-band antenna.

Description of Related Art

In a digital television system complied with the advanced television systems committee (ATSC) standard, a transmitting antenna of a transmitting terminal is configured to transmit an electromagnetic wave in a vertical polarization manner and energy thereof is focused in the horizontal plane. For achieving a better performance, a receiving antenna of a receiving terminal must has the same vertical polarization, and energy of the receiving antenna must also be focused in the horizontal plane.

Generally, with reference to FIG. 1, a dipole antenna 110 and a monopole antenna 120 of the conventional art has characteristics of vertical polarization and focusing energy into a horizontal plane and thus, can be applied to the digital television systems. However, the conventional dipole antenna 110 and the monopole antenna 120 cannot achieve dual-band operation and as a result, cannot simultaneously support the very high frequency (VHF) band and the ultra-high frequency (UHF) band used by the digital television systems.

SUMMARY

The invention provides a dual-band antenna capable of achieving dual-band operation and has radiation characteristics of vertical polarization and focusing energy into a horizontal plane.

The invention is directed to a dual-band antenna, including a ground element, a radiation element and at least one open slot. The radiation element has a bending to form a first radiation portion and a second radiation portion. The first radiation portion has a feeding point adjacent to the ground element. In addition, a width of the first radiation portion is gradually increased along a direction far away from the ground element. The second radiation portion forms an orthogonal projection on the ground element. The at least one open slot passes through the second radiation portion.

In an embodiment of the invention, the first radiation portion is symmetrical to a first reference line, and the ground element is symmetrical to a second reference line. Additionally, the first reference line and the second reference line intersect with each other to form an intersection point.

In an embodiment of the invention, the dual-band antenna further includes a first extension element. The first extension element is electrically connected to the first radiation portion and intersects with the first radiation portion at the first reference line. Additionally, a width of the first extension element is gradually increased along the direction far away from the ground element.

To sum up, in the dual-band antenna of the invention, the radiation element has a bending to form the first radiation portion and the second radiation portion. Additionally, the first radiation portion has a shape with a wide top and a narrow bottom, and the second radiation portion forms a meandering structure through the at least one open slot. Thereby, the dual-band antenna can achieve dual-band operation and have radiation characteristics of vertical polarization and focusing energy into a horizontal plane.

In order to make the aforementioned and other features and advantages of the invention more comprehensible, several embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
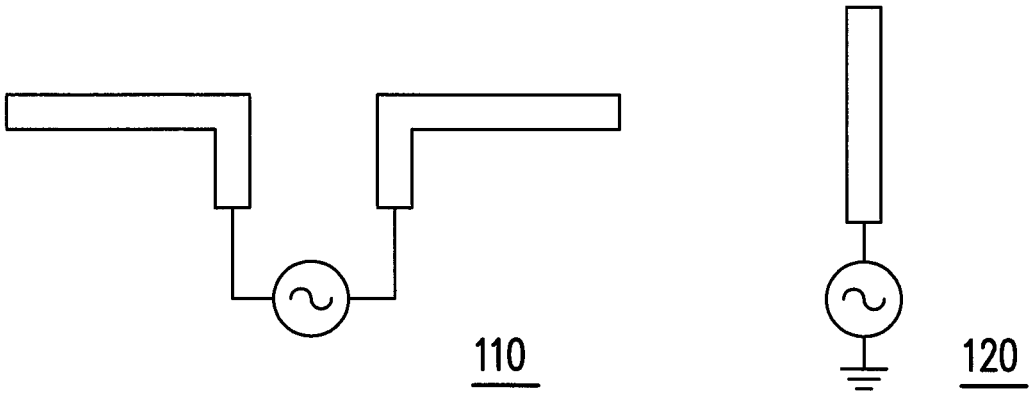
FIG. 1 (PRIOR ART)
FIG. 1 is a schematic diagram illustrating a conventional dipole antenna and a conventional monopole antenna.
Figure 2:
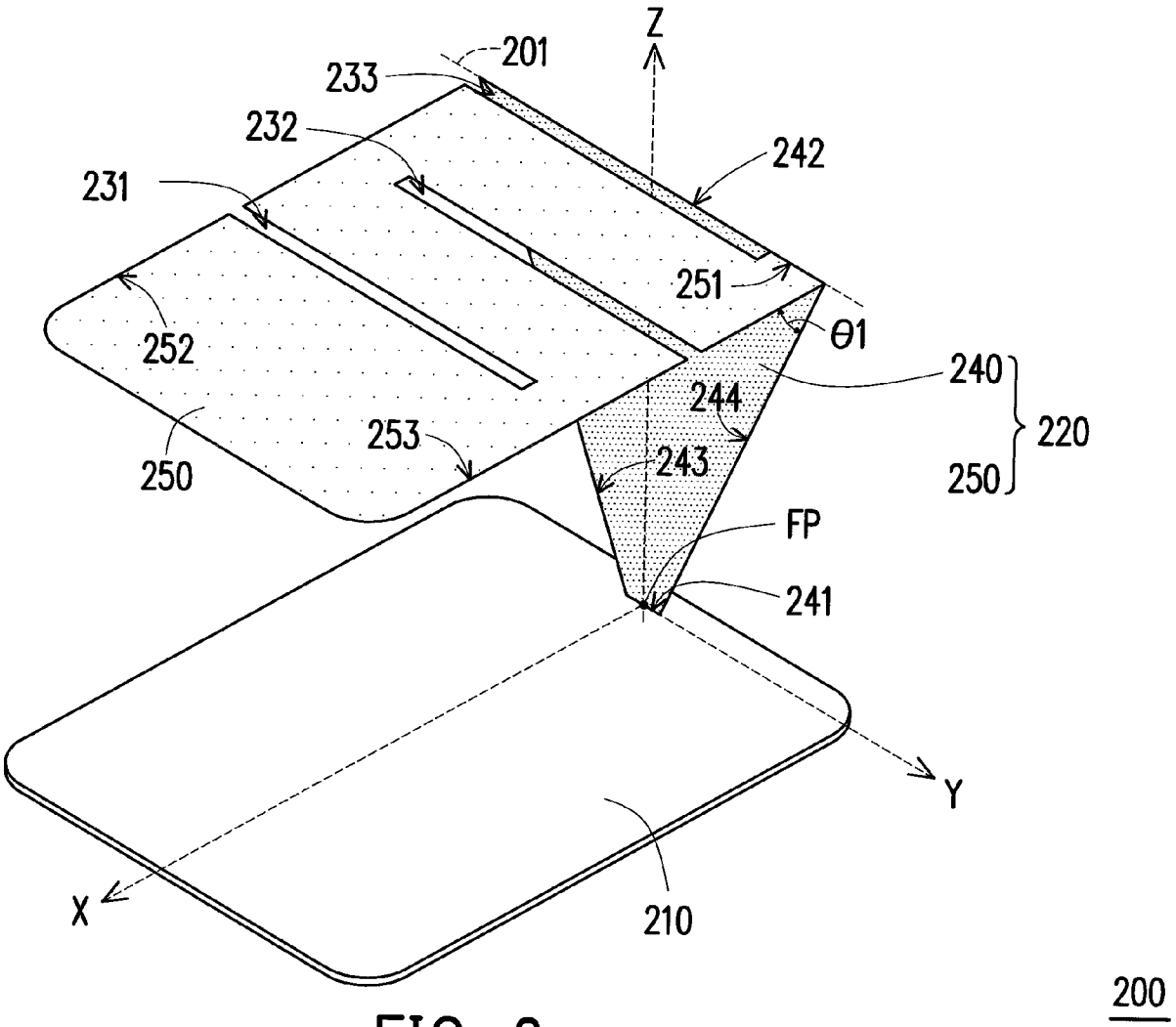
FIG. 2 is a schematic diagram illustrating a dual-band antenna according to an embodiment of the invention.

FIG. 2 is a schematic diagram illustrating a dual-band antenna according to an embodiment of the invention. Referring to FIG. 2, a dual-band antenna 200 includes a ground element 210, a radiation element 220 and a plurality of open slots 231 to 233. The radiation element 220 has a bending 201 to form a first radiation portion 240 and a second radiation portion 250.

The first radiation portion 240 stands on the ground element 210, and the second radiation portion 250 forms an orthogonal projection on the ground element 210. In another aspect, an included angle θ1 is between the first radiation portion 240 and the second radiation portion 250, and the included angle θ1 is greater than 0 degree and smaller than 180 degrees. For instance, in the embodiment illustrated in FIG. 2, the included angle θ1 between the first radiation portion 240 and the second radiation portion 250 is 90 degrees, such that the radiation element 220 has an L-shaped structure.

The first radiation portion 240 has a feeding point FP adjacent to the ground element 210. Additionally, a width of the first radiation portion 240 is gradually increased along a direction (e.g., the Z-axial direction) far away from the ground element 210. Namely, the first radiation portion 240 has a shape with a wide top and a narrow bottom. Thus, a shape of the first radiation portion 240 may be, for example, bowtie-shaped or trapezoid-shaped. The open slots 231 to 233 pass through the second radiation portion 250. Additionally, the open slots 231 to 233 are alternately arranged on the second radiation portion 250, such that the second radiation portion 250 has a meandering structure. Thereby, the second radiation portion 250 may facilitate in increasing an effective length of the dual-band antenna 200.

In operation, the dual-band antenna 200 receives a feeding signal through the feeding point FP. Under the excitation by the feeding signal, the dual-band antenna 200 may be operated in a first band (e.g., an UHF band) through the first radiation portion 240. Additionally, the second radiation portion 250 may facilitate in increasing the effective length of the dual-band antenna 200, such that the dual-band antenna 200 may be further operated in a second band (e.g., a VHF band). Besides, the bending 201 of the radiation element 220, the shape with the wide top and the narrow bottom of the first radiation portion 240 and the open slots 231 to 233 of the second radiation portion 250 all contribute to miniaturization of the dual-band antenna 200, such that the dual-band antenna 200 has a compact size.

Furthermore, the dual-band antenna 200 is substantially a monopole antenna. Thus, the dual-band antenna 200 can achieve not only dual-band operation but also radiation characteristics of vertical polarization and focusing energy into a horizontal plane. Additionally, the dual-band antenna 200 has a substantially omni-directional radiation pattern in the horizontal plane, such that the dual-band antenna 200 can further meet demands for actual application scenarios.

Moreover, the first radiation portion 240 has a short edge 241, a long edge 242, a first side edge 243 and a second side edge 244. The feeding point FP is on the short edge 241 of the first radiation portion 240. The long edge 242 of the first radiation portion 240 is electrically connected to the second radiation portion 250. The width of the first radiation portion 240 is defined by the first side edge 243 and the second side edge 244 of the first radiation portion 240.

The second radiation portion 250 has a first edge 251, a second edge 252 and a third edge 253. The second edge 252 and the third edge 253 are adjacent to the first edge 251, and the first edge 251 is electrically connected to the first radiation portion 240. Additionally, openings of the open slot 231 and the open slot 233 are located at the second edge 252, and an opening of the open slot 232 is located at the third edge 253. In other words, the open slots 231 to 233 are alternately arranged on the second radiation portion 250, and the openings of two adjacent open slots are respectively located at two opposite edges 252 and 253, such that the second radiation portion 250 has a meandering structure.

Even though FIG. 2 exemplarily illustrates an implementation aspect of the open slots of the second radiation portion 250, the embodiment illustrated in FIG. 2 construes no limitations to the invention. For instance, on another embodiment, the dual-band antenna 200 includes only one open slot (e.g., one of the open slots 231 to 233), and the dual-band antenna 200 forms the meandering structure of the second radiation portion 250 by using only one open slot. Additionally, in yet another embodiment, the dual-band antenna 200 may also include, for example, two open slots (e.g., the open slots 231 and 232). In other words, the dual-band antenna 200 includes at least one open slot and forms the meandering structure of the second radiation portion 250 by using the at least one open slot.

Referring to FIG. 2 continuously, the first radiation portion 240 is symmetrical to a first reference line (e.g., the Z axis), and the ground element 210 is symmetrical to a second reference line (e.g., the X axis). Additionally, the first reference line and the second reference line intersect with each other to form an intersection point (e.g., the origin of coordinates). It should be noted that persons having ordinary skill in the art may adjust the position of the intersection point of the two reference lines so as to increase the effective length of the dual-band antenna 200. For instance, in the embodiment illustrated in FIG. 2, the intersection point of the first reference line and the second reference line is adjacent to an edge of the ground element 210. Thereby, the effective length of the dual-band antenna 200 may be further increased, such that the radiation characteristic of the dual-band antenna 200 operated in the second band (e.g., the VHF band) is improved.

Figure 3:
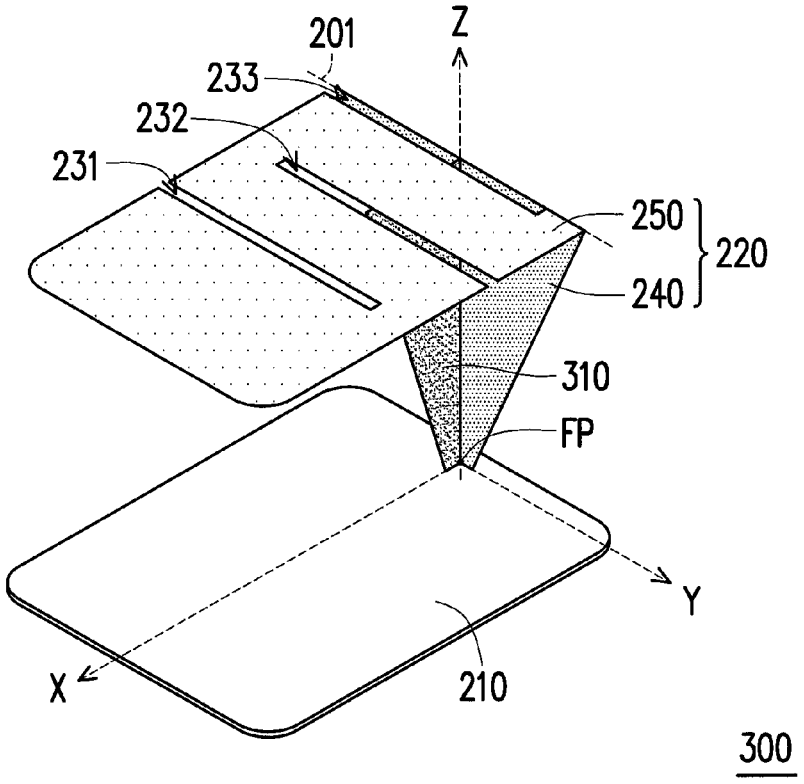
FIG. 3 is a schematic diagram illustrating a dual-band antenna according to another embodiment of the invention.
Figure 4:
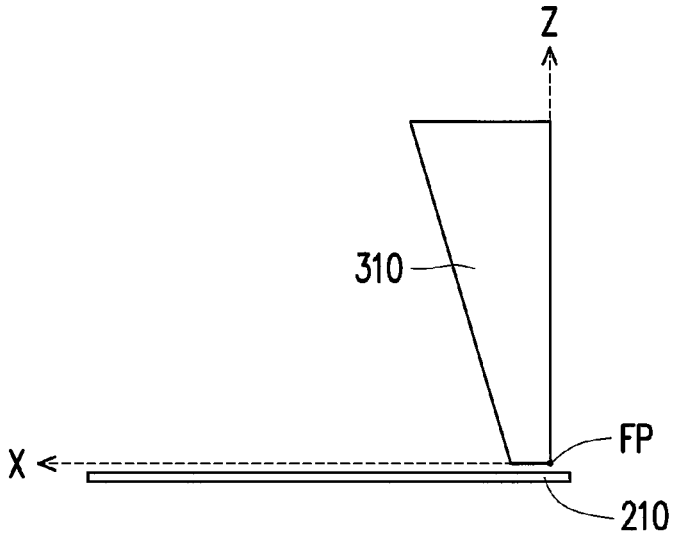
FIG. 4 is a schematic cross-sectional diagram of the dual-band antenna depicted in FIG. 3.

It should be noted that symmetry of the radiation pattern of the dual-band antenna 200 may further be improved by using extension elements, such that the radiation pattern of the dual-band antenna 200 tends to be more omni-directional. For instance, FIG. 3 is a schematic diagram illustrating a dual-band antenna according to another embodiment of the invention, and FIG. 4 is a schematic cross-sectional diagram of the dual-band antenna depicted in FIG. 3. FIGS. 3-4 illustrate a dual-band antenna 300 that is similar to the dual-band antenna 200 illustrated in FIG. 2, and the difference between the embodiment of FIG. 2 and the embodiment of FIG. 3 is that the dual-band antenna 300 further includes a first extension element 310.

Specifically, the first extension element 310 is electrically connected to the first radiation portion 240. Additionally, the first radiation portion 240 is symmetrical to the first reference line (e.g., the Z axis), and the first extension element 310 intersects with the first radiation portion 240 at the first reference line (e.g., the Z axis). Furthermore, a width of the first extension element 310 is gradually increased along the direction (e.g., the Z-axial direction) far away from the ground element 210. Thereby, the symmetry of the radiation patterns of the dual-band antenna 300 may be improved by using the first extension element 310. Specially, the radiation pattern of the dual-band antenna 300 operated in the first band (e.g., the UHF band) tends to be more omni-directional in response to the configuration of the first extension element 310. Detailed configuration and operation with respect to each element of the embodiment illustrated in FIGS. 3-4 have been contain in the context related to the embodiment above and will not be repeated hereinafter.

Figure 5:
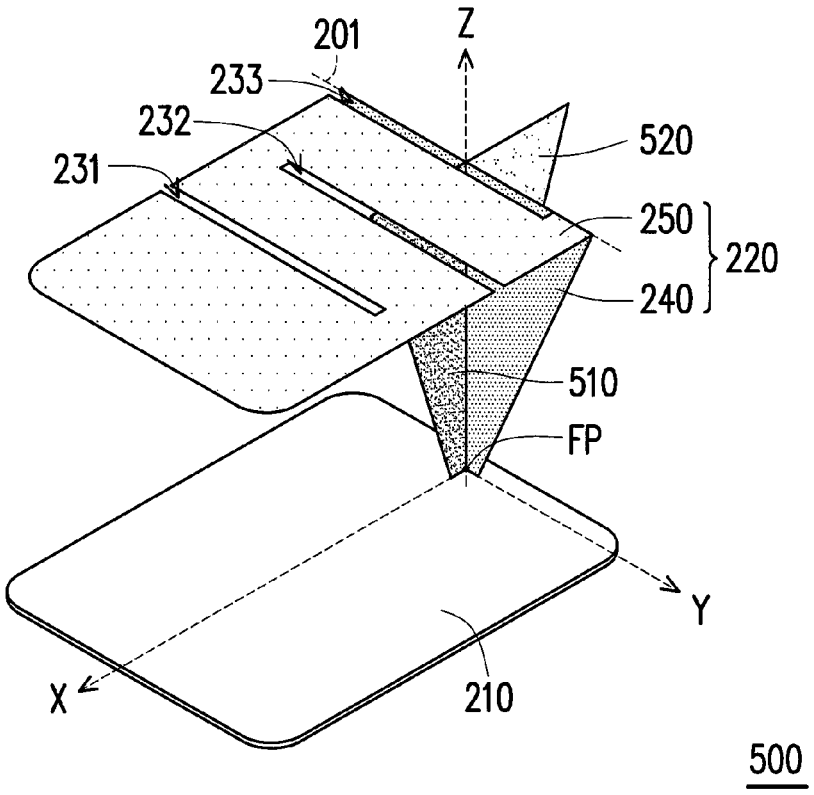
FIG. 5 is a schematic diagram illustrating a dual-band antenna according to yet another embodiment of the invention.
Figure 6:
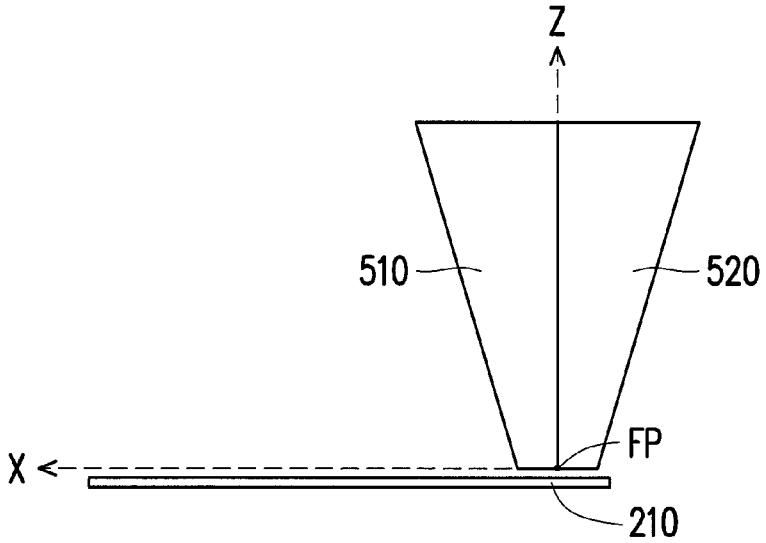
FIG. 6 is a schematic cross-sectional diagram of the dual-band antenna depicted in FIG. 5.

FIG. 5 is a schematic diagram illustrating a dual-band antenna according to yet another embodiment of the invention, and FIG. 6 is a schematic cross-sectional diagram of the dual-band antenna depicted in FIG. 5. FIGS. 5-6 illustrate a dual-band antenna 500 that is similar to the dual-band antenna 200 illustrated in FIG. 2, and the difference between the embodiment of FIG. 2 and the embodiment of FIG. 5 is that the dual-band antenna 500 further includes a first extension element 510 and a second extension element 520.

Specifically, the first extension element 510 and the second extension element 520 are electrically connected to the first radiation portion 240 and located at two sides of the first radiation portion 240. Additionally, the first radiation portion 240 is symmetrical to the first reference line (e.g., the Z axis). The first extension element 510, the second extension element 520 and the first radiation portion 240 intersect at the first reference line (e.g., the Z axis). Thereby, the symmetry of the radiation patterns of the dual-band antenna 500 may be improved by using the first extension element 510 and the second extension element 52. Detailed configuration and operation with respect to each element of the embodiment illustrated in FIGS. 5-6 have been contain in the context related to the embodiments above and will not be repeated hereinafter.

Figure 7:
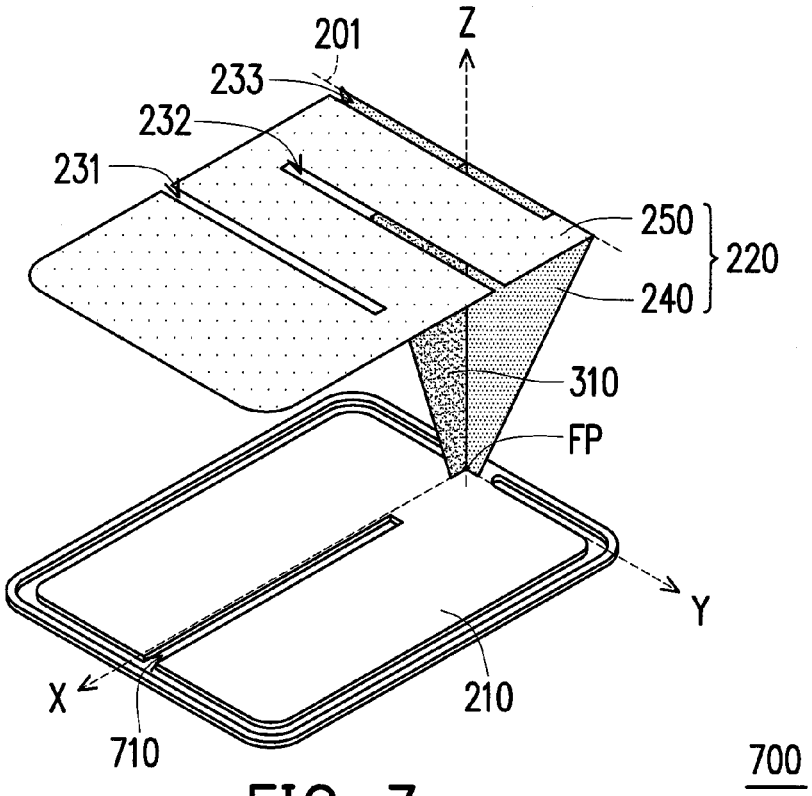
FIG. 7 is a schematic diagram illustrating a dual-band antenna according to still another embodiment of the invention.

It should be noted that a closed slot may be configured on the ground element 210 in each of the dual-band antennas 200, 300 and 500 to further reduce the height of the antenna or enhance radiation performance of the antenna. For instance, FIG. 7 is a schematic diagram illustrating a dual-band antenna according to still another embodiment of the invention. FIG. 7 illustrates a dual-band antenna 700 that is similar to the dual-band antenna 300 illustrated in FIG. 3, and the difference between the embodiment of FIG. 3 and the embodiment of FIG. 7 is that the dual-band antenna 700 further includes a closed slot 710.

Specifically, the closed slot 710 passes through the ground element 210. Additionally, both the ground element 210 and the closed slot 710 are symmetrical to the second reference line (e.g., the X axis). In operation, the closed slot 710 may facilitate in changing a reflection phase of an electromagnetic wave on the ground element 210, such that the reflection phase is smaller than 180 degrees. In this way, the height of the dual-band antenna 700 may be reduced, or radiation performance of the dual-band antenna 700 may be enhanced. Specially, in case that the height of the dual-band antenna 700 is fixed, the closed slot 710 may further facilitate in increasing the radiation performance of the dual-band antenna 700 operated in the second band (e.g., the VHF band).

Figure 8:
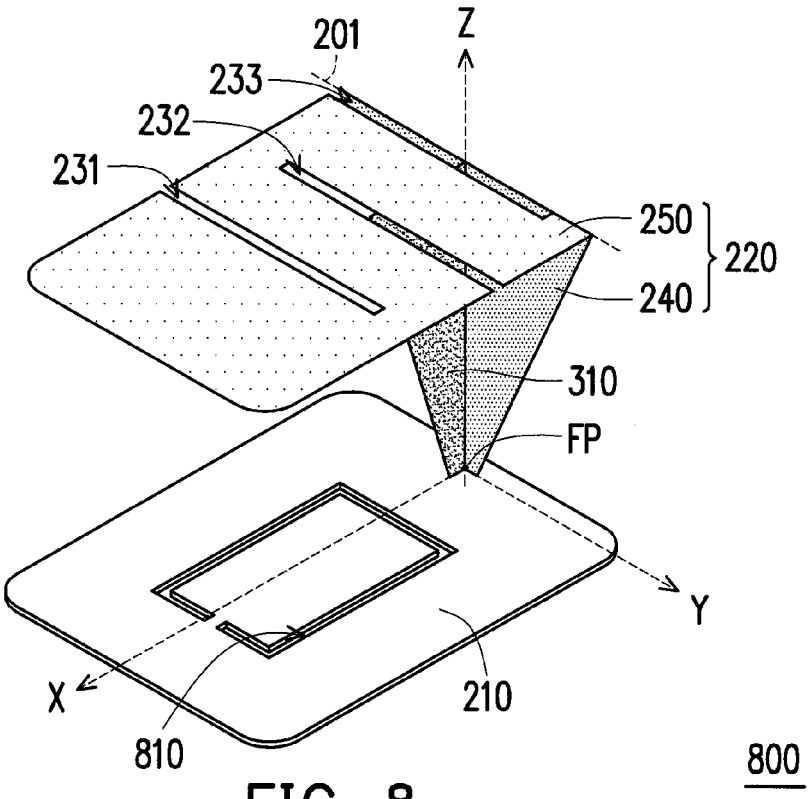
FIG. 8 is a schematic diagram illustrating a dual-band antenna according to further another embodiment of the invention.

Even though FIG. 7 exemplarily illustrates an implementation aspect of the closed slot 710 of the ground element 210, the embodiment illustrated in FIG. 7 construes no limitations to the invention. Persons having ordinary skill in the art may implement the closed slot 710 of the ground element 210 by utilizing any geometric shape symmetrical to the second reference line. For instance, FIG. 8 is a schematic diagram illustrating a dual-band antenna according to further another embodiment of the invention. In comparison with the embodiment of FIG. 3, FIG. 8 illustrates a dual-band antenna 800 further including a closed slot 810. The closed slot 810 passes through the ground element 210, and the closed slot 810 is symmetrical to second reference line (e.g., the X axis). Additionally, a length of the closed slot 810, i.e., a distance between two ends of the closed slot 810, is ½ wavelength of a center frequency of the second band (e.g., the VHF band).

Figure 9A:
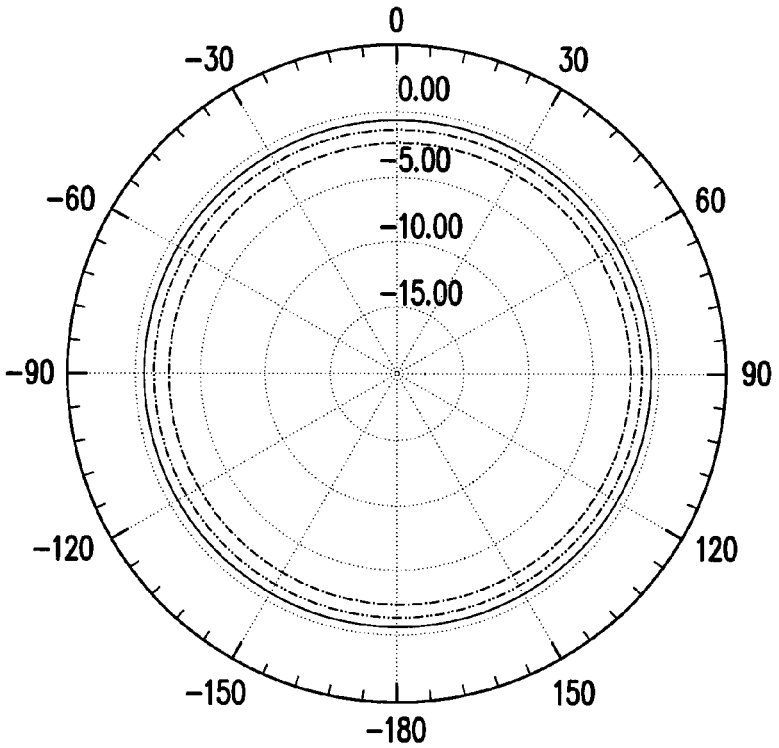
FIG. 9A and FIG. 9B respectively illustrate patterns that the dual-band antenna is operated in the second band according to an embodiment of the invention.
Figure 9B:
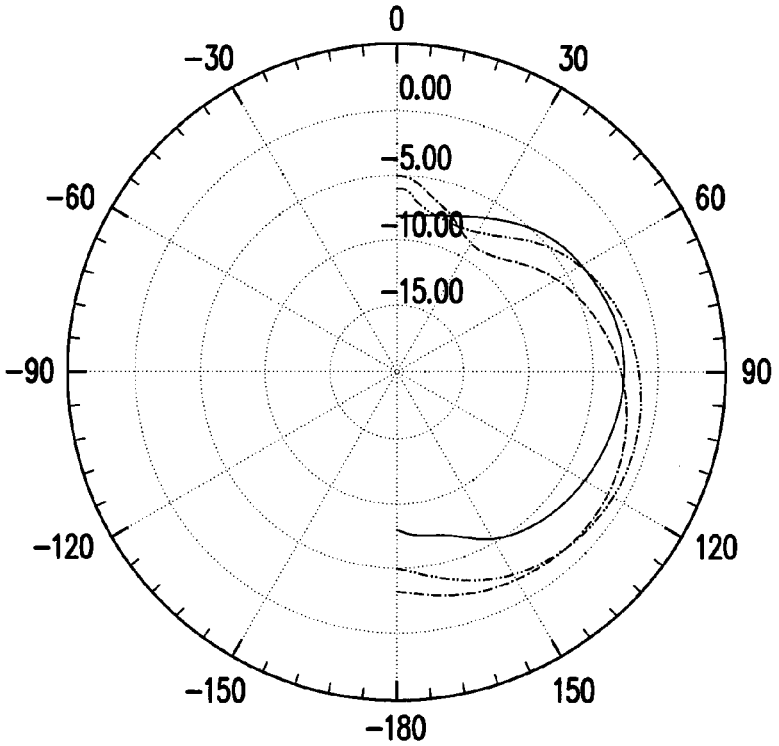

In summary, the symmetry of the radiation pattern of the dual-band antenna 700 illustrated in FIG. 7 may be improved by using the first extension element 310, and the radiation performance may be further enhanced through the closed slot 710 on the ground element 210. For instance, FIG. 9A and FIG. 9B respectively illustrate patterns that the dual-band antenna is operated in the second band according to an embodiment of the invention. FIG. 9A and FIG. 9B illustrate radiation patterns of the dual-band antenna 700 operated in the VHF band with operation frequencies, such as 0.174 GHz, 0.195 GHz and 0.216 GHz, on a horizontal plane and a vertical plane, respectively.

Figure 10A:
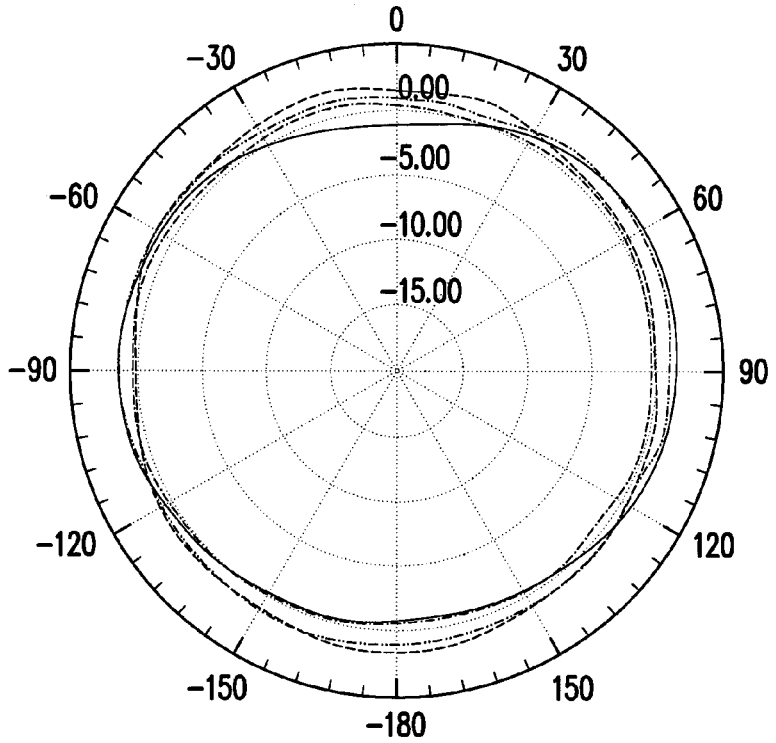
FIGS. 10A and 10B respectively illustrate patterns that the dual-band antenna is operated in a first band according to an embodiment of the invention.
Figure 10B:
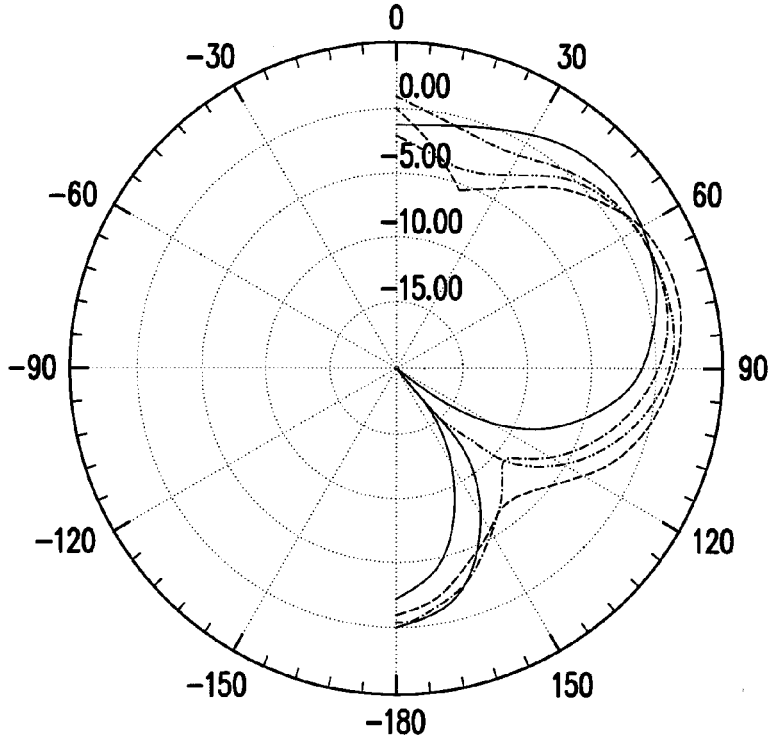

Additionally, FIGS. 10A and 10B respectively illustrate patterns that the dual-band antenna is operated in a first band according to an embodiment of the invention. FIGS. 10A and 10B illustrate radiation patterns of the dual-band antenna 700 operated in the UHF band with operation frequencies, such as 0.47 GHz, 0.546 GHz, 0.622 GHz and 0.698 GHz on a horizontal plane and a vertical plane, respectively. Referring to FIGS. 9A, 9B, 10A and 10B, in both the VHF and the UHF bands, energy of the dual-band antenna 700 is focused in the horizontal plane, and the dual-band antenna 700 has good omni-directional radiation patterns. Detailed configuration and operation with respect to each element of the embodiment illustrated in FIGS. 7-8 have been contain in the context related to the embodiment above and will not be repeated hereinafter.

Figure 11:
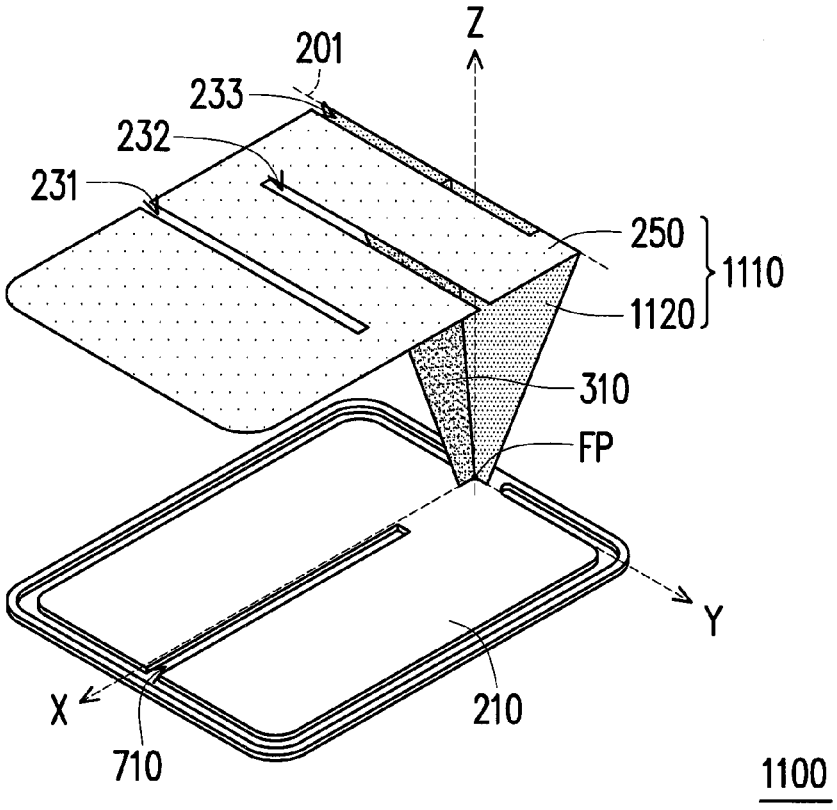
FIG. 11 is a schematic diagram illustrating a dual-band antenna according to another embodiment of the invention.
Figure 12:
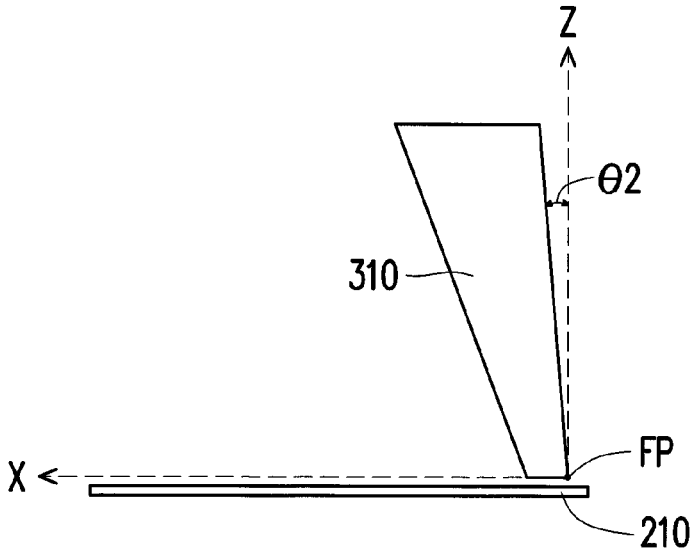
FIG. 12 a schematic cross-sectional diagram of the dual-band antenna depicted in FIG. 11.

On the other hand, the radiation element 220 of the dual-band antennas 200, 300, 500, 700 or 800 may tilt on and be fixed to the ground element 210 to meet actual requirements of appearance design for production. For instance, FIG. 11 is a schematic diagram illustrating a dual-band antenna according to another embodiment of the invention, and FIG. 12 a schematic cross-sectional diagram of the dual-band antenna depicted in FIG. 11. FIGS. 11-12 illustrated a dual-band antenna 1100 which is similar to the dual-band antenna 700 illustrated in FIG. 7, and the difference between the embodiment of FIG. 7 and the embodiment of FIG. 11 is that the dual-band antenna 1100 includes a first radiation portion 1120 and second radiation portion 250, wherein the first radiation portion 1120 tilts relatively to the Z axis for a predetermined angle θ2. The predetermined angle θ2 may be, for example, 5 degrees. Thereby, the appearance of the dual-band antenna 1100 may have smoother streamline structure.

To summarize, in the dual-band antenna of the invention, the radiation element has the bending to form the first radiation portion and the second radiation portion. Additionally, the first radiation portion has a shape with a wide top and a narrow bottom, and the second radiation portion forms a meandering structure through at least one open slot. Thereby, the dual-band antenna can achieve dual-band operation and have radiation characteristics of vertical polarization and focusing energy into a horizontal plane. Additionally, the bending of the radiation element, the shape with the wide top and the narrow bottom of the first radiation portion and at least one open slot of the second radiation portion further contribute to miniaturization of the dual-band antenna. Moreover, the symmetry of the radiation patterns of the dual-band antenna can be improved by using the extension elements, and radiation performance of the dual-band antenna can be enhanced by means of the closed slot on the ground element.

Although the invention has been described with reference to the above embodiments, it will be apparent to one of the ordinary skill in the art that modifications to the described embodiment may be made without far from the spirit of the invention. Accordingly, the scope of the invention will be defined by the attached claims not by the above detailed descriptions.

What is claimed is:

1. A dual-band antenna, comprising:

a ground element;

a radiation element, having a bending to form a first radiation portion and a second radiation portion, wherein the first radiation portion is symmetrical to a first reference line and has a short edge, a long edge electrically connected to the second radiation portion, a first side edge and a second side edge, a feeding point is adjacent to the ground element and disposed on the short edge of the first radiation portion, a width of the first radiation portion is increased along a direction far away from the ground element and defined by the first side edge and the second side edge of the first radiation portion, the second radiation portion forms an orthogonal projection on the ground element and has a first edge electrically connected to the first radiation portion, a second edge and a third edge, and the second edge and the third edge of the second radiation portion are adjacent to the first edge of the second radiation portion;

at least one open slot, passing through the second radiation portion to form a meandering structure of the second radiation portion; and a first extension element, electrically connected to the first radiation portion and intersecting with the first radiation portion at the first reference line, wherein a width of the first extension element is gradually increased along the direction far away from the ground element.

2. The dual-band antenna according to claim 1, wherein the at least one open slot comprising:

a first open slot, passing through the second radiation portion and having an opening located at the second edge.

3. The dual-band antenna according to claim 2, wherein the at least one open slot further comprises:

a second open slot, passing through the second radiation portion and having an opening at the third edge.

4. The dual-band antenna according to claim 1, wherein the ground element is symmetrical to a second reference line, and the first reference line and the second reference line intersect with each other to form an intersection point.

5. The dual-band antenna according to claim 4, wherein the intersection point is adjacent to an edge of the ground element.

6. The dual-band antenna according to claim 1, further comprising:

a second extension element, electrically connected to the first radiation portion and intersecting with the first radiation portion at the first reference line, wherein the second extension element and the first extension element are located at two sides of the first radiation portion, and a width of the second extension element is gradually increased along the direction far away from the ground element.

7. The dual-band antenna according to claim 4, further comprising:

a closed slot, passing through the ground element and being symmetrical to the second reference line.

8. The dual-band antenna according to claim 7, wherein the dual-band antenna is operated in a first band and a second band, the first band is higher than the second band, and a length of the closed slot is ½ wavelength of a center frequency of the second band.

9. The dual-band antenna according to claim 1, wherein a shape of the first radiation portion is bowtie-shaped or trapezoid-shaped.

* * * * *